US006527508B2

(12) United States Patent
Groskreutz et al.

(10) Patent No.: US 6,527,508 B2
(45) Date of Patent: Mar. 4, 2003

(54) ACTUATOR CRANK ARM DESIGN FOR VARIABLE NOZZLE TURBOCHARGER

(76) Inventors: Mark Groskreutz, 385 Loma Ave., Long Beach, CA (US) 90814; David Beatty, 1845 Chasewood Dr., Austin, TX (US) 78727

( * ) Notice: Subject to any disclaimer, the term of this patent is extended or adjusted under 35 U.S.C. 154(b) by 0 days.

(21) Appl. No.: 09/922,991

(22) Filed: Aug. 3, 2001

(65) Prior Publication Data

US 2003/0026694 A1 Feb. 6, 2003

(51) Int. Cl.[7] ..... F02D 23/00; F01D 17/16

(52) U.S. Cl. ..... 415/164; 415/150; 415/163; 60/602

(58) Field of Search ..... 415/150, 159–166; 60/602; 74/595–600, 594.1, 594.2, 594.3; 81/60

(56) References Cited

U.S. PATENT DOCUMENTS 921,529 A * 5/1909 Etnier ..... 415/163
1,246,200 A * 11/1917 White ..... 415/163
4,324,158 A * 4/1982 Le Roy ..... 81/60
4,679,984 A 7/1987 Swihart et al.
4,804,316 A 2/1989 Fluery
5,115,699 A * 5/1992 Mertens ..... 81/60
6,269,642 B1 * 8/2001 Arnold et al. ..... 60/602

* cited by examiner

*Primary Examiner*—Christopher Verdier
(74) *Attorney, Agent, or Firm*—Ephraim Starr

(57) ABSTRACT

A turbocharger with variable geometry turbine inlet nozzle employs a rotating unison ring for actuation of multiple vanes. A crank arm engages a slot in the unison ring to convert linear actuator motion into rotation of the unison ring. A crank pin having a rectangular tongue adapted to be received in the slot and a circular body received in an aperture in the crank arm reduces contact stresses between the crank tongue and unison ring slot. The crank pin is retained in the crank arm by the unison ring and center housing flange of the turbocharger.

3 Claims, 3 Drawing Sheets

ACTUATOR CRANK ARM DESIGN FOR VARIABLE NOZZLE TURBOCHARGER

FIELD OF THE INVENTION

This invention relates generally to the field of variable geometry turbochargers and, more particularly, to an actuator crank arm that is used to operate a unison ring and that is specially configured to have a reduced contact stress, when compared to convention actuator crank arm designs, thereby providing improved operational efficiency and lengthened service reliability.

BACKGROUND OF THE INVENTION

Turbochargers for gasoline and diesel internal combustion engines are devices known in the art that are used for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing. The exhaust gas-driven turbine is mounted onto one end of a shaft that is common to a radial air compressor mounted onto an opposite end of the shaft and housed in a compressor housing. Thus, rotary action of the turbine also causes the air compressor to spin within a compressor housing of the turbocharger that is separate from the turbine housing. The spinning action of the air compressor causes intake air to enter the compressor housing and be pressurized or boosted a desired amount before it is mixed with fuel and combusted within the engine combustion chamber.

In a turbocharger it is often desirable to control the flow of exhaust gas to the turbine to improve the efficiency or operational range of the turbocharger. Variable geometry turbochargers have been configured to address this need. A type of such variable geometry turbocharger is one having a variable exhaust nozzle, referred to as a variable nozzle turbocharger. Different configurations of variable nozzles have been employed in variable nozzle turbochargers to control the exhaust gas flow. One approach taken to achieve exhaust gas flow control in such variable nozzle turbochargers involves the use of multiple pivoting vanes that are positioned annularly around the turbine inlet.

In previous embodiments of variable nozzle turbochargers such as that disclosed in U.S. patent application Ser. No.: 09/408,694 entitled "Variable Geometry Turbocharger", now U.S. Pat. No. 6,269,642, having a common assignee with the present application, the pivoting vanes are commonly controlled by a unison ring that is positioned within the turbine housing. The unison ring is operated to vary the pitch of the multiple pivoting vanes by an actuator shaft that extends from a turbocharger center housing into the turbine housing. An actuator crank arm is attached at the end of the shaft and includes an outwardly projecting pin that registers with a slot in the unison ring. The unison ring is rotated to open or close the plurality of vanes by rotation of the crank arm and movement of the pin within the slot. It is known that this pin-in-slot cooperating interaction between the actuator crank and the unison ring places a large degree of contact stress on the pin and arm during operation. The large degree of contact stress is known to cause binding and other undesired effects that impair the efficient and reliable operation of the unison ring.

It is, therefore, desired that an actuator crank arm and unison ring be configured in a manner such that the connecting mechanism between the two provide a reduced amount of contact stress on one or both of the members, when compared to the conventional design. This improved connecting mechanism is desired for purposes of increasing operational efficiency and extending service reliability, and ultimately the service life of a turbocharger comprising the same.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION OF THE INVENTION

A variable geometry or variable nozzle turbocharger generally comprises a center housing having a turbine housing attached at one end, and a compressor housing attached at an opposite end. A shaft is rotatably disposed within a bearing assembly contained within the center housing. A turbine or turbine wheel is attached to one shaft end and is disposed within the turbine housing, and a compressor impeller is attached to an opposite shaft end and is disposed within the compressor housing. The turbine and compressor housings are attached to the center housing by bolts that extend between the adjacent housings.

Figure 1:
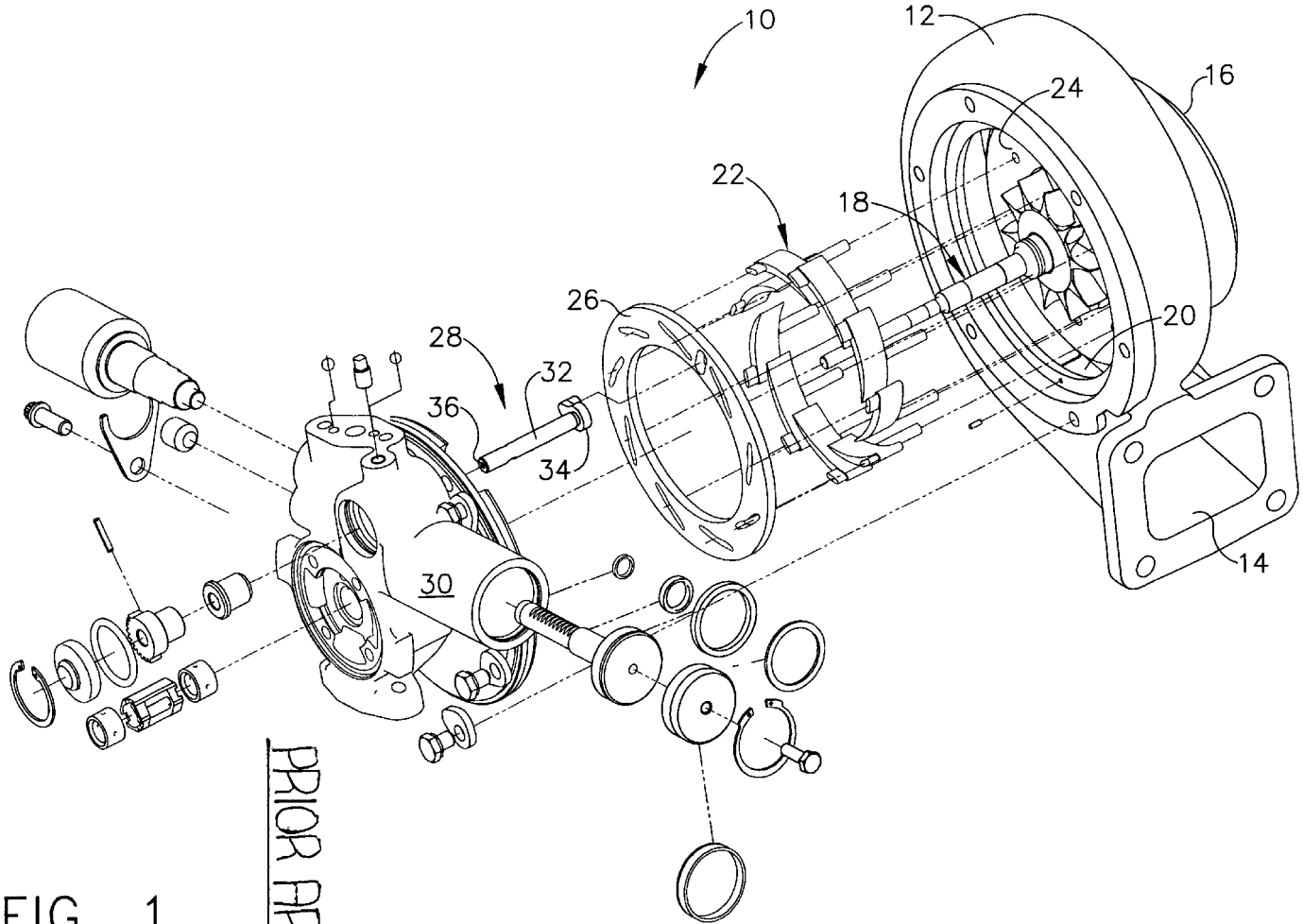
PRIOR ART FIG. 1
FIG. 1 is a perspective partial view of a known variable nozzle turbocharger.

FIG. 1 illustrates a portion of a variable nozzle turbocharger 10, as disclosed in patent application Ser. No.: 09/408,694, now U.S. Pat. No. 6,269,642. Previously mentioned, comprising a turbine housing 12 having a standard inlet 14 for receiving an exhaust gas stream, and an outlet 16 for directing exhaust gas to the exhaust system of the engine. A volute is connected to the exhaust inlet and an integral outer nozzle wall is incorporated in the turbine housing casting adjacent the volute. A turbine wheel and shaft assembly 18 is carried within the turbine housing. Exhaust gas, or other high energy gas supplying the turbocharger, enters the turbine through the inlet and is distributed through the volute in the turbine housing for substantially radial entry into the turbine wheel through a circumferential nozzle entry 20.

Multiple vanes 22 are mounted to a nozzle wall 24 machined into the turbine housing using shafts that project perpendicularly outwardly from the vanes and that are rotationally engaged within respective openings in the nozzle wall. The vanes each include actuation tabs that project from a side opposite the shafts and that are engaged by respective slots in a unison ring 26, which acts as a second nozzle wall.

An actuator assembly 28 is disposed within a turbocharger center or bearing housing 30 and generally comprises an actuator shaft 32, means for rotatably retaining the shaft within the center housing, and means for rotating or actuating the shaft within the center housing. The actuator shaft 32 includes a first axial end that is attached to a crank arm 34 and that is connected with the unison ring 26. The shaft first end projects outwardly a distance from a wall of the center housing that functionally forms a wall of the turbine housing. The actuator shaft includes an opposite second axial end 36 that is disposed within an opening through the center housing 30, and that is carried therein by a bearing and seal assembly. The actuator shaft is actuated to rotate the crank arm by a hydraulic actuating means. Additional examples of known variable nozzle turbochargers comprising such elements are disclosed in U.S. Pat. Nos. 4,679,984 and 4,804,316, which are both incorporated herein by reference.

Figure 2:
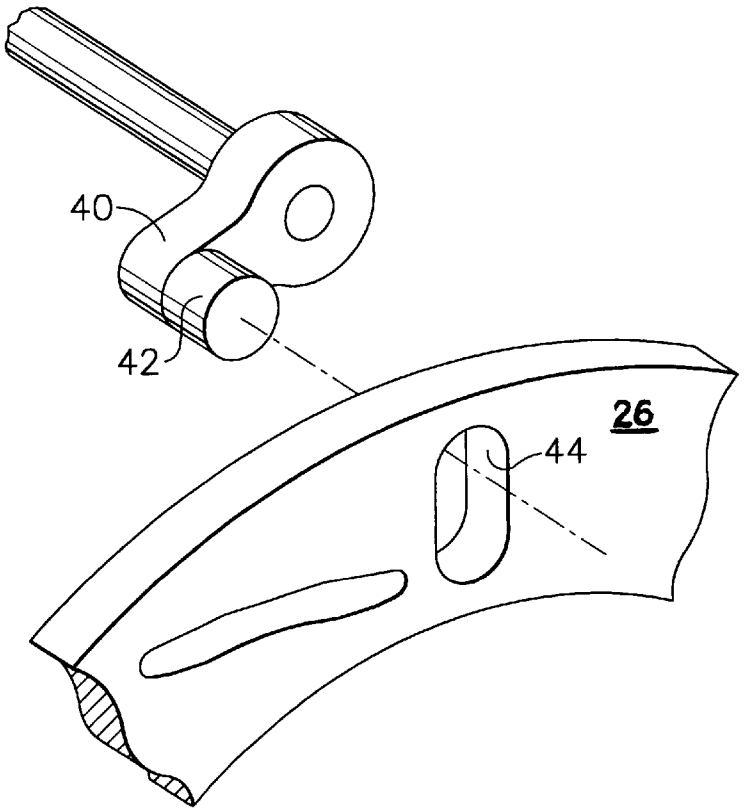
FIG. 2 PRIOR ART
FIG. 2 is a perspective partial view of a prior art actuator crank arm.

FIG. 2 illustrates in greater detail an actuator crank arm 40 from the variable nozzle turbocharger of FIG. 1. The crank arm 40 includes a crank pin 42 that is fixedly attached at an end of the arm and that projects outwardly a distance therefrom. The pin 42 is sized and configured for placement within a slot or slotted opening 44 within the unison ring 26. Configured and attached in this manner, the crank arm effects rotational movement of the unison ring vis-a-vis the turbine housing by both rotational movement of the pin within the slot, and traveling scraping movement of the pin lengthwise across in the slot as the unison ring is rotated. As described briefly above in the background, this interaction between the crank arm and unison ring imposes a large degree of contact stress on the fixedly attached pin 42, which has been measured at approximately 120 kpsi.

This large degree of contact stress is largely a result of the lengthwise scraping movement of the pin within the slot and the cantilevered fixed arrangement of the pin in the crank arm. This unchecked contact stress both impairs the efficient actuation of the unison ring, and is known to cause excessive wear at the crank pin/unison ring interface, which can ultimately reduce the service life of the turbocharger.

Figure 3:
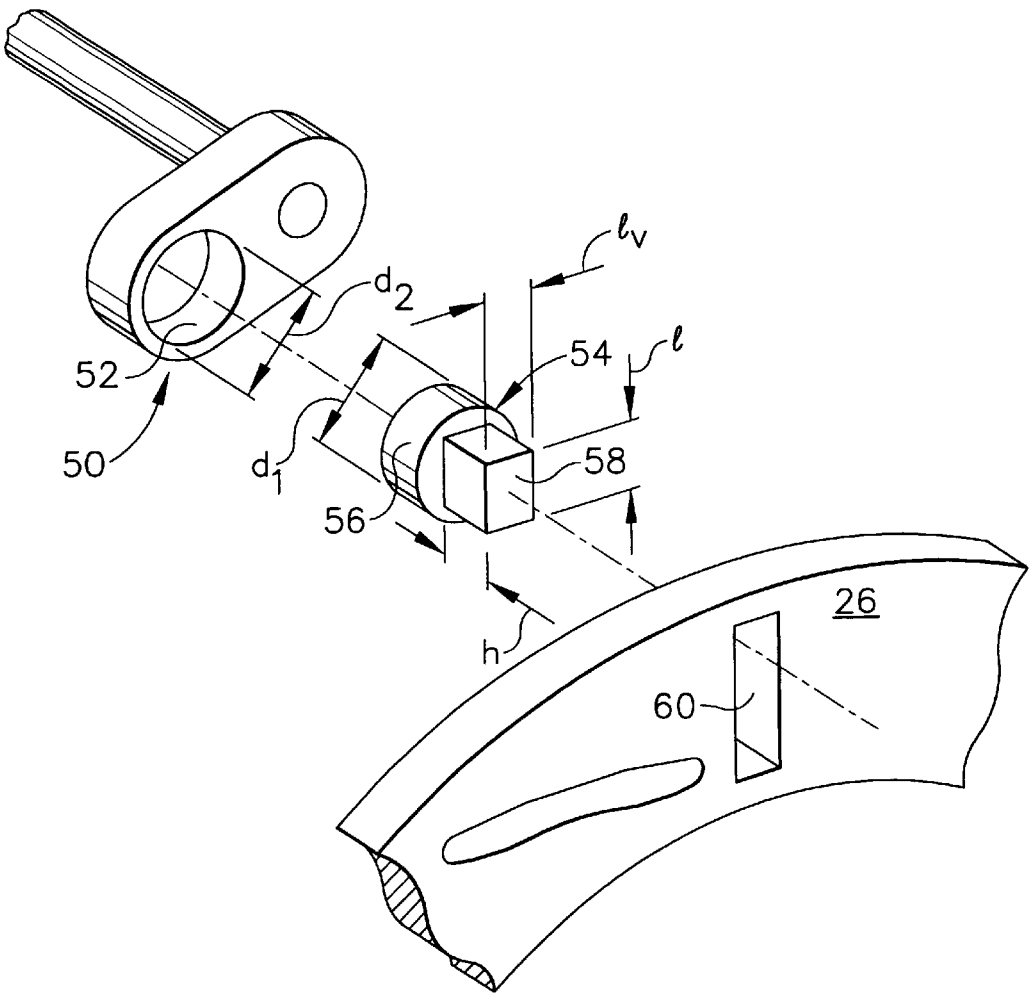
FIG. 3 is a perspective partial view of an actuator crank arm and unison ring assembly constructed according to the principles of this invention.

FIG. 3 illustrates an actuator crank arm 50, of this invention, that is specifically designed to reduce the contact stress resulting from the crank arm/unison ring interaction. Specifically, the actuator crank arm 50 comprises an opening 52 disposed adjacent an end of the arm that is sized to accommodate placement of a crank pin 54 therein. The crank pin 54 includes a base 56 that is sized having a diameter that is slightly smaller than that of the opening 52 to facilitate rotational movement of the pin within the opening. The differences in diameter between the pin and opening, however, should be sufficiently small as to avoid any binding of the two members caused by off-axial orientation.

The crank pin 54 includes a tongue 58 that projects outwardly away from the base 56 a sufficient distance. In an example embodiment, the tongue 58 is shaped having a rectangular configuration that is sized and shaped to fit within a complementary slot 60 in the unison ring 26. As illustrated in FIG. 3, in an example embodiment, the slot is also in the shape of a rectangle having a lengthwise dimension that is greater than that of the tongue. More specifically, the slot is sized such that it only permits back and forth lengthwise movement of the tongue therein, thereby eliminating the high contact stress rotational movement of the pin within the slot.

The pin 54 is axially retained within the crank arm opening 52 by the unison ring and the center housing flange when the diameter of the base 54 is larger than the smallest dimension, i.e., width, of the tongue 58, thereby requiring no additional part to axially retain the pin.

Although rotational movement of the pin is still necessary to provide proper actuation of the unison ring, the specific construction of this invention contains such rotational movement between the pin 54 and the crank arm hole 52. Since this rotational movement occurs at the junction between the pin and crank arm there is no moment arm or cantilevered force imposed at the point of rotation, thereby eliminating or greatly reducing the contact stress imposed therebetween. Thus, configured in this manner, actuating movement of the unison ring is achieved at two separate locations between two different interfacing members; namely, at the unison ring between the slot and the tongue 58 sliding therein, and at the crank arm 50 between the opening 52 and the pin 54 rotating therein. Breaking the actuation movement into two different components each performed at different interface locations has been shown to reduce the contact stress imposed on the pin from approximately 120 kpsi to approximately 1.2 kpsi.

Having now described the invention in detail as required by the patent statutes, those skilled in the art will recognize modifications and substitutions to the specific embodiments disclosed herein. Such modifications are within the scope and intent of the present invention.

What is claimed:

1. A variable geometry turbocharger assembly comprising:

a turbine housing having a turbine wheel disposed therein that is attached to a shaft;

a center housing connected at one of its ends to the turbine wheel and including a bearing assembly disposed therein for rotatably carrying the shaft;

a turbine housing backing plate interposed between the center housing and turbine housing;

a plurality of vanes disposed within the turbine housing;

an annular unison ring positioned within the turbine housing and connected to the plurality of vanes;

an actuator crank arm connected to the unison ring, the crank arm comprising:

an opening disposed at one end of the crank arm; and a pin rotatably attached to the crank arm, the pin including a base that is rotatably disposed within the opening, and a tongue that projects axially outwardly a distance away from the base, the tongue being sized and configured to fit within a slot disposed through the unison ring; and means for operating the actuator crank arm.

2. The variable geometry turbocharger assembly as recited in claim 1 wherein the slot is in the shape of a rectangle, the tongue is in the shape of a rectangle, and the tongue is disposed within the slot to slide lengthwise therein.

3. A variable geometry turbocharger assembly comprising:

a turbine housing having a turbine wheel disposed therein that is attached to a shaft;

a center housing including a bearing assembly disposed therein for rotatably carrying the shaft;

a plurality of vanes disposed within the turbine housing;

an annular unison ring positioned within the turbine housing and connected to the plurality of vanes;

an actuator crank arm connected to the unison ring, the crank arm comprising:

an opening disposed at one end of the crank arm; and a pin rotatably attached to the crank arm, the pin including a base that is rotatably disposed within the opening, and a tongue that projects axially outwardly a distance away from the base, the tongue being sized and configured to fit within a slot disposed through the unison ring; and means for operating the actuator crank arm.

* * * * *